US009816790B2

(12) United States Patent
Biggs et al.

(10) Patent No.: US 9,816,790 B2
(45) Date of Patent: Nov. 14, 2017

(54) SHOCK HARDENED INITIATOR AND INITIATOR ASSEMBLY

(71) Applicant: Raytheon Company, Waltham, MA (US)

(72) Inventors: Bradley Biggs, Corona, AZ (US); Timothy B. Bonbrake, Tucson, AZ (US); George Darryl Budy, Tuscon, AZ (US); Christopher Schott, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 14/257,181

(22) Filed: Apr. 21, 2014

(65) Prior Publication Data

US 2014/0224142 A1 Aug. 14, 2014

Related U.S. Application Data

(63) Continuation of application No. 13/022,164, filed on Feb. 7, 2011, now Pat. No. 8,701,557.

(51) Int. Cl.
*F42B 3/12* (2006.01)
*F42C 9/00* (2006.01)
(Continued)

(52) U.S. Cl.
CPC ..... *F42B 3/124* (2013.01); *F42B 3/125* (2013.01); *F42C 9/00* (2013.01); *F42C 14/00* (2013.01); *F42C 19/02* (2013.01)

(58) Field of Classification Search
CPC .. F42B 3/12; F42B 3/124; F42B 3/121; F42B 3/128; F42B 3/13
(Continued)

(56) References Cited

U.S. PATENT DOCUMENTS 2,399,034 A 4/1946 Huyett
3,363,565 A 1/1968 Walther
(Continued)

FOREIGN PATENT DOCUMENTS

WO WO-2005025937 A2 3/2005
WO WO-2012108931 A1 8/2012
WO WO-2016134028 A1 8/2016

OTHER PUBLICATIONS

"U.S. Appl. No. 13/022,164, Non Final Office Action mailed May 21, 2013", 14 pgs.
(Continued)

*Primary Examiner* — Benjamin P Lee
(74) *Attorney, Agent, or Firm* — Schwegman Lundberg & Woessner, P.A.

(57) ABSTRACT

Embodiments of an initiator support assembly that includes an initiator housing including an initiator cavity system are generally described herein. In some embodiments, a bridge substrate is positioned within the initiator cavity. The bridge substrate includes a substrate base including a uniform first planar surface and an opposed second surface. The bridge substrate further includes a first bridge contact extending over the substrate base. The first bridge contact is substantially flush with the first planar surface. A second bridge contact extends over the substrate base. The second bridge contact is substantially flush with the first planar surface. The first and second bridge contacts and the uniform first planar surface form a continuous planar mounting surface. An explosive charge, positioned within the initiator cavity, includes a charge mounting surface that is continuously coupled in surface-to-surface contact across the continuous planar mounting surface.

16 Claims, 3 Drawing Sheets

(51) Int. Cl.
*F42C 14/00* (2006.01)
*F42C 19/02* (2006.01)

(58) Field of Classification Search
USPC ..... 102/200, 202.5, 202.8, 202.9, 202.12, 102/202.14, 206
See application file for complete search history.

(56) References Cited

U.S. PATENT DOCUMENTS

| | | | |
|---|---|---|---|
| 3,763,782 | A | 10/1973 | Bendler |
| 5,088,413 | A | 2/1992 | Huber et al. |
| 5,454,320 | A | 10/1995 | Hilden et al. |
| 5,686,691 | A | 11/1997 | Hamilton et al. |
| 5,969,286 | A | 10/1999 | Ward et al. |
| 6,158,347 | A | 12/2000 | Neyer et al. |
| 6,502,512 | B2 | 1/2003 | Riviere et al. |
| 6,672,215 | B2 | 1/2004 | Daoud et al. |
| 6,907,827 | B2 | 6/2005 | Tirmizi et al. |
| 7,770,520 | B2 | 8/2010 | Fink et al. |
| 7,866,264 | B2 | 1/2011 | Nance et al. |
| 8,408,131 | B1 | 4/2013 | Nance et al. |
| 8,485,097 | B1 | 7/2013 | Nance et al. |
| 8,701,557 | B2 | 4/2014 | Biggs |
| 2002/0178956 | A1 | 12/2002 | Mattes et al. |
| 2008/0134921 | A1 | 6/2008 | Nance et al. |
| 2008/0148982 | A1 | 6/2008 | Hennings et al. |
| 2009/0223400 | A1 | 9/2009 | Hill |
| 2009/0266260 | A1 | 10/2009 | Nance et al. |
| 2011/0072997 | A1 | 3/2011 | Nance et al. |
| 2012/0199030 | A1 | 8/2012 | Biggs et al. |
| 2016/0178333 | A1 | 6/2016 | Biggs et al. |

OTHER PUBLICATIONS

"U.S. Appl. No. 13/022,164, Notice of Allowance mailed Dec. 6, 2013", 10 pgs.
"U.S. Appl. No. 13/022,164, Response filed Aug. 30, 2013 to Non Final Office Action mailed May 21, 2013", 18 pgs.
"International Application Serial No. PCT/US/2011/064906, International Search Report mailed Apr. 19, 2012", 2 pgs.
"International Application Serial No. PCT/US2011/064906, International Preliminary Report on Patentability mailed Aug. 22, 2013", 8 pgs.
"International Application Serial No. PCT/US2011/064906, Written Opinion mailed Apr. 19, 2012", 6 pgs.
"U.S. Appl. No. 14/625,144, Non Final Office Action mailed Mar. 9, 2016", 15 pgs.
"International Application Serial No. PCT/US2016/018285, International Search Report dated Jun. 1, 2016", 5 pgs.
"International Application Serial No. PCT/US2016/018285, Written Opinion dated Jun. 1, 2016", 10 pgs.
U.S. Appl. No. 14/625,144, Response filed Jun. 9, 2016 to Non-Final Office Action dated Mar. 9, 2016, 12 pgs.
"U.S. Appl. No. 14/625,144, Non Final Office Action dated Sep. 16, 2016", 17 pgs.
"U.S. Appl. No. 14/625,144, Final Office Action dated Apr. 14, 2017", 19 pgs.
"U.S. Appl. No. 14/625,144, Notice of Allowance dated Sep. 19, 2017", 8 pgs.
"U.S. Appl. No. 14/625,144, Response filed Aug. 14, 2017 to Final Office ACtion dated Apr. 14, 2017", 16 pgs.
"International Application Serial No. PCT/US2016/018285, International Preliminary Report on Patentability dated Aug. 31, 2017", 12 pgs.

SHOCK HARDENED INITIATOR AND INITIATOR ASSEMBLY

CLAIM OF PRIORITY

This patent application is a continuation of and claims the benefit of priority to U.S. patent application Ser. No. 13/022,164 entitled "SHOCK HARDENED INITIATOR AND INITIATOR ASSEMBLY" filed Feb. 7, 2011, the entire contents of which are hereby incorporated in its entirety.

TECHNICAL FIELD

Embodiments pertain to explosive initiation. Some embodiments relate to initiators and initiator assemblies.

BACKGROUND

Explosive payloads are delivered in a variety of vehicles including missiles, gun fired projectiles, bombs and the like. Targets are located within hardened structures having impact and explosive resistant walls or structure (e.g., overlying rock and the like). Successful delivery of the payload to the target often requires penetration of the payload through the protective structure followed by detonation within or near the target.

Impact and penetration of the delivery vehicle and explosive payload transmits significant shock loads to the sensitive materials within the vehicle and causes one or more of acceleration, deceleration, rebounding of materials, movement of the material relative to other sensitive components and the like. One sensitive feature within the delivery vehicle is the initiator used to detonate the explosive payload. The shock loading and rapid deceleration of the delivery vehicle transmits stress to the explosive charge within the initiator. The stress may cause the explosive charge to crack and correspondingly prevent proper initiation of the charge resulting in failure of the explosive payload to detonate.

SUMMARY

In accordance with some embodiments, an initiator assembly and method for supporting an explosive charge is discussed that supports the initiator components during delivery, impact and penetration and ensures reliable initiation and corresponding detonation of the explosive payload. Other features and advantages will become apparent from the following description of the preferred example, which description should be taken in conjunction with the accompanying drawings.

BRIEF DESCRIPTION OF THE DRAWINGS

A more complete understanding of the present subject matter may be derived by referring to the detailed description and claims when considered in connection with the following illustrative Figures. In the following Figures, like reference numbers refer to similar elements and steps throughout the Figures.

Elements and steps in the Figures are illustrated for simplicity and clarity and have not necessarily been rendered according to any particular sequence. For example, steps that may be performed concurrently or in different order are illustrated in the Figures to help to improve understanding of examples of the present subject matter.

DETAILED DESCRIPTION

In the following detailed description, reference is made to the accompanying drawings which form a part hereof, and in which is shown by way of illustration specific examples in which the subject matter may be practiced. These examples are described in sufficient detail to enable those skilled in the art to practice the subject matter, and it is to be understood that other examples may be utilized and that structural changes may be made without departing from the scope of the present subject matter. Therefore, the following detailed description is not to be taken in a limiting sense, and the scope of the present subject matter is defined by the appended claims and their equivalents.

The present subject matter may be described in terms of functional block components and various processing steps. Such functional blocks may be realized by any number of techniques, technologies, and methods configured to perform the specified functions and achieve the various results. For example, the present subject matter may employ various materials, actuators, electronics, shape, airflow surfaces, reinforcing structures, explosives and the like, which may carry out a variety of functions. In addition, the present subject matter may be practiced in conjunction with any number of devices, and the systems described are merely exemplary applications.

Figure 1:
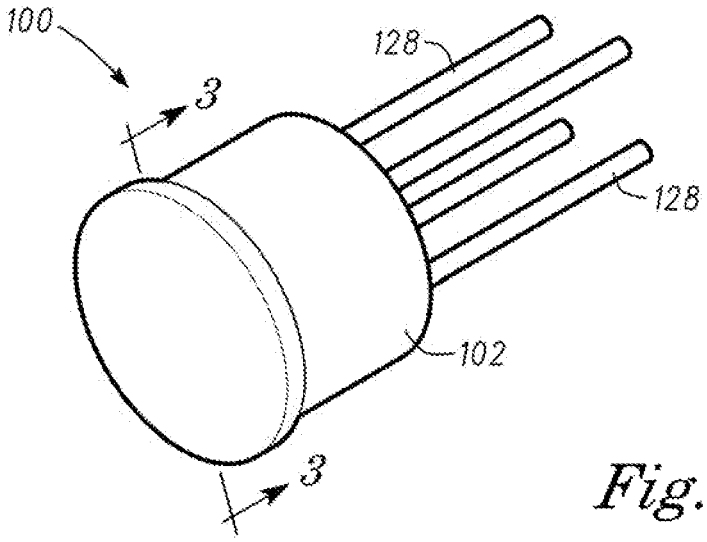
FIG. 1 is a perspective view of one example of an initiator assembly in accordance with some embodiments.

FIG. 1 shows one example of an initiator assembly 100 for use in an explosive payload delivery device, including but not limited to, a gun-fired projectile, missile, bomb and the like. The initiator assembly 100 includes, as shown in FIG. 1, an initiator housing 102 and one or more initiator leads 128 extending from the initiator housing 102. In one example, the initiator leads 128 are coupled with a current source, such as a capacitor. As will be described in further detail below, transmission of current from the capacitor through the initiator leads 128 detonates an explosive charge within the initiator housing 102 configured to initiate and detonate an explosive payload within the explosive delivery device.

Figure 2:
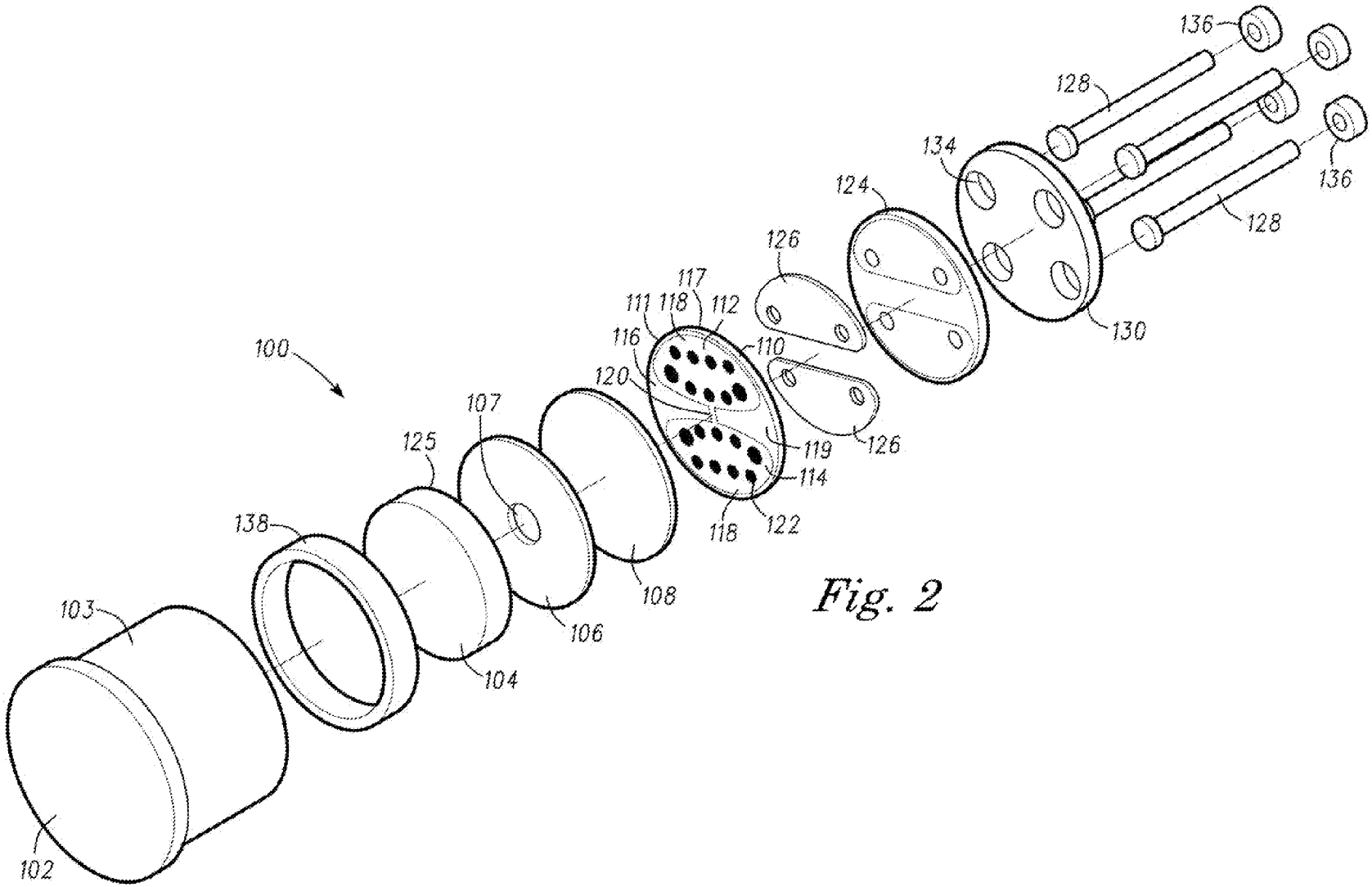
FIG. 2 is an exploded view of the initiator assembly shown in FIG. 1 in accordance with some embodiments.

Referring now to FIG. 2, an exploded view of the initiator assembly 100 is shown. The initiator assembly 100 includes the initiator housing 102 shown previously in FIG. 1 along with a series of components sized and shaped to fit within an initiator cavity 103. Referring again to FIG. 2, the initiator assembly 100 includes an explosive charge 104 sized and shaped for reception within the initiator cavity 103. A barrel 106 is positioned adjacent to the explosive charge 104. The barrel 106 includes a barrel lumen 107. A flyer plate 108 is positioned on the opposed side of the barrel 106 relative to the explosive charge 104. As will be described in further detail below, when the initiator assembly 100 is activated the flyer plate 108 is projected toward the explosive charge 104 and passes, at least in part, through the barrel lumen 107 to initiate a surface to surface impact with the charge mounting surface 125 of the explosive charge 104. Striking of the explosive charge 104 by the flyer plate 108 initiates the explosive charge 104 and correspondingly detonates the explosive payload of the delivery device the initiator assembly 100 is housed within.

Referring again to FIG. 2, the initiator assembly 100 further includes a bridge substrate 110. As shown in FIG. 2, the bridge substrate 110 is sized and shaped to snugly fit within the initiator cavity 103. Stated another way, the bridge substrate 110 includes a surface area substantially corresponding to a corresponding cross sectional surface area covered by the initiator cavity 103 and the explosive charge 104. In the example shown in FIG. 2, the initiator assembly 100 further includes a circuit board 124 positioned immediately adjacent to the bridge substrate 110. As shown in FIG. 2, the circuit board 124 includes a surface area closely matching the surface area of the bridge substrate 110. The assembly 100 further includes one or more solder plates 126 positioned between the bridge substrate 110 and the circuit board 124. The solder plates 126 provide an electrical intermediate between the initiator leads 128 and the first and second bridge contacts 112, 114 shown in FIG. 2. The initiator assembly 100 further includes, in the example shown, a header 130 adjacent to the circuit board 124. As shown in FIG. 2, the header 130 includes a plurality of lead lumens 134 sized and shaped to receive and thereby pass initiator leads 128 therethrough. The lead lumens 134 in another example are sized and shaped to receive insulators 136, such as glass insulators interposed between the initiator leads 128 and the header 130. The insulators 136 snugly position the initiator leads 128 within the header 130, insulate the initiator leads 128 from each other as well as the header 130, and in at least one example hermetically seal the initiator leads 128 to the header 130.

Assembly of the bridge substrate 110 and circuit board 124, in one example, is accomplished with an adhesive interposed between portions of the bridge substrate 110 and the circuit board 124. In another example, the adhesive extends around the circuit board 124 and bridge substrate 110 to combine the bridge substrate and circuit board 124 into a single unitary element. Alternatively, the adhesive used to couple the circuit board 124 with the bridge substrate 110 is also used to couple the header 130 with the assembly of the bridge substrate 110 and the circuit board 124. In one example, the adhesive includes a non-conductive insulative adhesive that substantially prevents arcing from the bridge substrate 110 to the header 130. In another example, the bridge substrate 110 includes plated through holes 122 providing a conductive via from the first and second bridge contacts 112, 114 to the underlying circuit board 124 and initiator leads 128. In one example, solder plugs are positioned within the plated through holes 122 to tightly seal the connections between the bridge substrate 110 and the initiator leads 128 and provide enhanced current conduction from the initiator leads 128 to the first and second bridge contacts 112, 114. Optionally, the adhesive previously described is also used to fix one or more of the bridge substrate 110, the circuit board 124 or the header 130 within the initiator cavity 103. Stated another way, the adhesive fixes one or more of the bridge substrate, the circuit board and the header to the interior wall of the initiator cavity 103.

Referring again to FIG. 2, the bridge substrate 110 includes a substrate base 111 with the first and second bridge contacts 112, 114 overlying the substrate base 111. As shown in FIG. 2, each of the first and second bridge contacts 112, 114 in an example are formed in a substantially ovular shape (e.g., a kidney shape) extending over a large portion of the surface area of the substrate base 111 of the bridge substrate 110. The first and second bridge contacts include contact surfaces that are substantially planar and flush to a uniform first planar surface of the substrate base 111. An ionizing bridge 120 extends between the first and second bridge contacts 112, 114. The uniform first planar surface 116 has a substantially flat configuration (and in at least one example provides a structurally robust surface) to ensure consistent and continuous surface-to-surface contact of the bridge substrate 110 with a charge mounting surface 125 of the explosive charge 104 (in one example, the barrel 106 and flyer plate 108 are interposed between the explosive charge and the bridge substrate, the planar surfaces of each of the barrel 106 and flyer plate 108 ensure surface to surface coupling between the explosive charge and the bridge substrate 110). The first and second bridge contacts 112, 114 are formed on the uniform first planar surface 116. In one example, the first and second bridge contacts provide a negligible elevation to the uniform first planar surface 116, for instance, 0.0001 inches relative to the surface 116. The contact surface 118 of the first and second bridge contacts 112, 114 along with the uniform first planar surface 116 thereby provide a continuous planar mounting surface 119 having a substantially flat and planar character to ensure surface to surface coupling with the explosive charge 104.

As shown in FIG. 2, the continuous planar mounting surface 119 formed by the first and second bridge contacts 112, 114 and the uniform first planar surface 116 has an area substantially similar to the area of the charge mounting surface 125 of the explosive charge 104. The matching areas of the explosive charge 104 and the bridge substrate 110 as well as the planar nature of each of the corresponding mounting surfaces 119, 125 ensures the explosive charge 104 and the bridge substrate 110 are coupled together in a surface to surface manner without localized points of contact therebetween. Stated another way, by ensuring consistent and uniform surface-to-surface contact across the areas of the explosive charge 104 and the bridge substrate 110 support is provided by the bridge substrate 110 to the entirety of the explosive charge 104 thereby minimizing stress risers incident on the explosive charge 104 during impact and penetration of an explosive delivery device with a target. During impact and penetration the initiator assembly 100 is exposed to rapid deceleration, acceleration, rebounding, movement of component pieces and the like. The bridge substrate 110 acts as a support to the explosive charge and minimizes fracture of the explosive in this dynamic environment.

As shown in FIG. 2, where the first and second bridge contacts 112, 114 include plated through holes 122, the through holes provide an intermediate conductor from the uniform first planar surface 116 to an opposed second surface 107 of the substrate base 111 of the bridge substrate 110. The plated through holes 122 further ensure the first and second bridge contacts 112, 114 provide a flat planar shape (e.g., contact surface 118) that cooperates with the uniform first planar surface 116 to form the continuous planar mounting surface 119. The plated through holes 122 are one example of an intermediate conductor used for connection with the circuit board 124 and initiator leads 128.

In another example, the bridge substrate 110 including the substrate base 111 is constructed with a rigid material including but not limited to ceramics, rigid insulators, and the like. The rigid structure of the bridge substrate 110 ensures the bridge substrate 110 provides rigid support to the ionizing bridge 120 during activation of the initiator assembly 100. For instance, when current is delivered through the first and second bridge contacts 112, 114 the ionizing bridge 120 is rapidly ionized and it develops a large pressure within the initiator cavity 103. The pressure developed by the ionizing bridge 120 is delivered violently to the flyer plate 108 and drives the flyer plate through the barrel 106 to strike the explosive charge 104 and initiate detonation of the explosive payload in the delivery device. The bridge substrate acts as a supporting plate to minimize deflection of the substrate 110 and ensure consistent delivery of pressure toward the explosive charge. As described above, the bridge substrate 110 also acts as a supporting plate to the explosive charge during impact and penetration of a target through surface to surface coupling therebetween.

Optionally, the bridge substrate 110 cooperates with the circuit board 124 and the header 130 to provide additional support to the substrate base 111 and thereby further contain and direct the pressure developed by the ionizing bridge 120 toward the explosive charge 104. Stated another way, one or more of the bridge substrate 110, the circuit board 124 and the header 130 provides structural support to the ionizing bridge 120 and substantially ensures pressure developed by the ionizing bridge 120 during activation of the initiator assembly is directed entirely toward the explosive charge 104 to ensure reliable initiation of the explosive charge with negligible deflection of the bridge substrate 110 in a direction opposed to the explosive charge 104.

In the example shown in FIG. 2 where the initiator assembly 100 includes a header 130 with insulators 136, the insulators 136 include glass. Coupling of the insulators around the initiator leads 128 causes wicking of the glass of the initiator leads 128 toward the circuit board 124. To avoid stress risers at the juncture between the insulators 136 and the circuit board 124 bevels are formed within the circuit board 124 to receive the wicked glass from the insulators 136, in one example. In another example, chamfers are formed within the lead lumens 134 to receive the wicked glass and thereby substantially prevent further wicking of the glass of the initiator leads 128. Surface-to-surface contact between the circuit board 124 and the header 130 is thereby maintained to ensure the initiator assembly 100 including the first substrate 110, the explosive charge 104, the circuit board 124 and the header 130 couple with surface-to-surface contact throughout to substantially prevent stress risers between any of the components.

Referring again to FIG. 2, the initiator assembly in another example includes an isolation sleeve 138 positioned within the initiator cavity 103 and extending around the explosive charge 104. In one example, the isolation sleeve 138 includes at least one polymer metals, such as steel and the like or combinations of polymers and metals. The isolation sleeve 138 extends around the explosive charge 104 and provides lateral support to the explosive charge 104. The surrounding isolation sleeve 138 ensures lateral forces transmitted to the explosive charge 104, for instance, during a non-perpendicular strike of the explosive delivery device against a target, do not result in lateral deformation and corresponding fracture of the explosive charge 104.

In some conventional initiator assemblies, the explosive charge may be fractured within an initiator housing. As will be discussed in further detail below, a conventional initiator assembly may include multiple features projecting in an irregular fashion between the explosive and a bridge substrate. These projections and recesses between projections cause the fracture of the explosive charge and failure of many conventional initiator assemblies to initiate. In conventional initiator assemblies, the initiator housing may be sized and shaped to receive the components of the initiator assembly therein. In conventional initiator assemblies, the initiator housing contains an explosive charge and a barrel adjacent to the explosive charge. As previously described above, the barrel includes a barrel lumen sized and shaped to pass at least a portion of a flyer plate through to facilitate striking of the explosive charge. Conventional initiator assemblies include means of connecting leads to the bridge, where such means consist of multiple parts which do not uniformly support the barrel and explosive.

In these conventional initiator assemblies, wires or other lead-to-bridge conductors electrically connect the leads to the bridge, creating a non-uniform surface above the bridge substrate for supporting the barrel and explosive. The glass between the leads and header may also extend beyond the header towards the explosive, creating another non-uniform surface for supporting the barrel and explosive. The leads also extend beyond the header, creating more non-uniform surfaces for supporting the barrel and explosive. Further, the bridge substrate has a square configuration that overlay a portion of the cross-sectional area of the header and the corresponding cross-sectional area of the explosive charge. Stated another way, the bridge substrate underlies only a portion of the explosive charge after assembly within the initiator assembly.

Combination of the leads, wires or lead-to-wire conductors, glass fillets, and the bridge substrate in conventional initiator assemblies provides an undulating uneven surface configured for point engagement with the barrel and coupling with the explosive charge. Engagement of the explosive charge (through the barrel) with the uneven surface of the lead, wire or lead-to-wire conductors, glass fillets (in some designs), and the bridge substrate provides point loading to the explosive charge. During impact of an explosive delivery device with a target the device experiences rapid deceleration with corresponding deceleration or acceleration of a conventional initiator assembly, depending on its orientation, as well as rebounding of the components within the initiator assembly and movement of components relative to each other within the assembly.

Damage through a dynamic environment to a conventional initiator assembly may include fracturing of the explosive charge because of force transmitted to the explosive charge at discreet locations from the leads and the smaller bridge substrate. Because the explosive charge is not consistently and uniformly supported by the bridge substrate the explosive charge may become cracked and will not properly initiate when the explosive delivery device impacts and penetrates the target.

In these conventional initiator assemblies, the bridge substrate may takes up less than 50 percent of the total area of the corresponding surface of the explosive charge. Stated another way, the bridge substrate would only support a portion of the area of the explosive charge leaving the remainder of the explosive charge free of support or supported by the uneven contact surfaces of the leads engaged with the barrel interposed therebetween. Minimal support is thereby provided to the explosive charge allowing force concentrations at portions of the explosive charge overlying each of the leads and unsupported portions of the explosive charge overlying areas of the initiator assembly not otherwise covered by the area of the bridge substrate.

Figure 3:
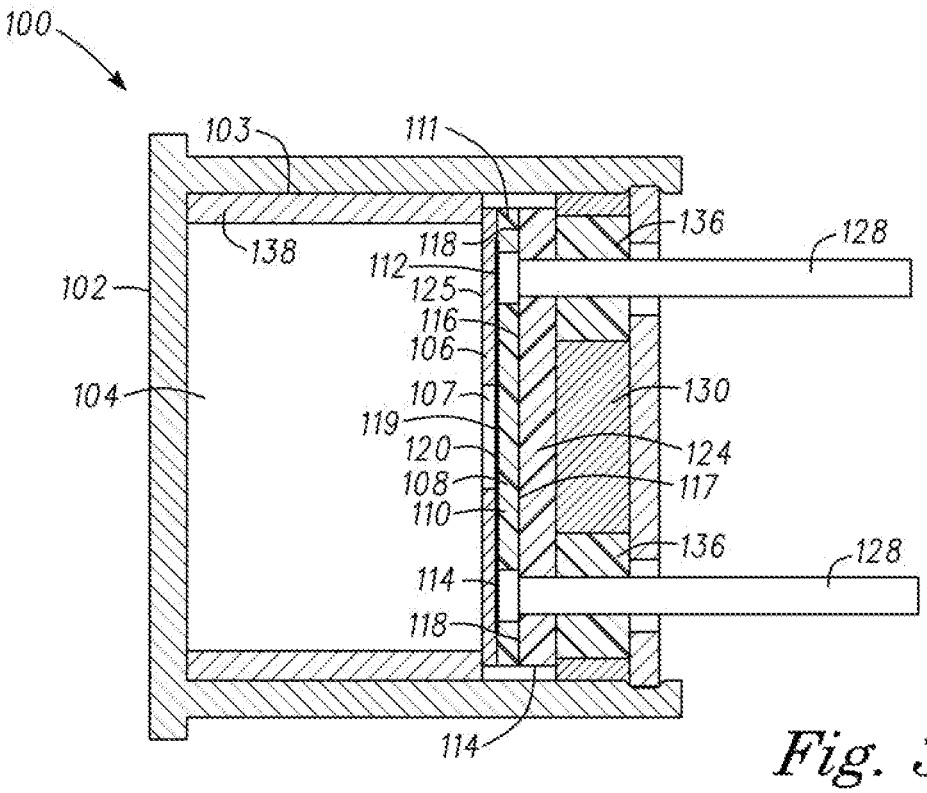
FIG. 3 is a cross sectional view of the initiator assembly shown in FIG. 1 in accordance with some embodiments.

FIG. 3 shows the initiator assembly 100 in a cross-sectional assembled view. As shown, the components of the initiator assembly 100 are housed within the initiator housing 102. For instance, the explosive charge 104 is positioned within the initiator cavity 103 with an isolation sleeve 138 extending around the explosive charge 104. As previously described herein, the isolation sleeve 138 supports the explosive charge 104 against lateral stresses caused by non-perpendicular impacts of an explosive delivery device with a target. Referring again to FIG. 3, the bridge substrate 110 is installed within the initiator cavity 103 adjacent to the circuit board 124 and the header 130. As shown, the initiator leads 128 extend through the header 130 where they are insulated by insulators 136 extending around the initiator leads 128. The initiator leads 128 further extend through the circuit board 124 and are electrically coupled with the first and second bridge contacts 112, 114 on the bridge substrate 110 (e.g., with solder pads 126, solder plugs and the like). As previously described, the bridge substrate 110 further includes an ionizing bridge 120 electrically coupled between the first and second bridge contacts 112, 114. Application of an electrical current through the first and second bridge contacts 112, 114 ionizes the ionizing bridge 120 creating a pressure within the initiator assembly 100 and forcing the flyer plate 108 through the barrel 106 to strike the explosive charge 104 and thereby initiate detonation of the explosive payload.

As shown in FIG. 3, the bridge substrate 110 and filled plated through holes provide a uniform first planar surface 116 and corresponding contact surfaces 118 on each of the first and second bridge contracts 112, 114. The plated through holes can be filled with solder or other material, As previously described herein, the contact surfaces 118 and the uniform first planar surface 116 of the substrate base 111 combine to form a continuous planar mounting surface 119. As shown in FIG. 3, the continuous planar mounting surface 119 extends across the initiator cavity 103 and has a coextensive surface area relative to the explosive charge 104. The continuous planar mounting surface 119 provides a flat and uniform surface for coupling along the entirety of the charge mounting surface 125 of the explosive charge 104. The explosive charge 104 is thereby supported along its entire surface by the bridge substrate 110. The uniform surface of the continuous planar mounting surface 119 is thereby continuously coupled in surface-to-surface contact across the charge mounting surface 125 of the explosive charge 104. During rapid deceleration, acceleration, rebounding or movement of components of the initiator assembly 100 relative to other components in the assembly a surface-to-surface contact between the continuous planar mounting surface 119 and the charge mounting surface 125 of the respective bridge substrate 110 and explosive charge 104 ensures stresses are not localized at any point along the explosive charge 104. Stated another way, the bridge substrate 110 including the continuous planar mounting surface 119 is coupled along the explosive charge 104 and supports the explosive charge 104 throughout dynamic loading of the explosive charge 104. The continuous surface to surface coupling between the bridge substrate and the explosive charge 104 thereby maintains the explosive charge 104 in a unitary undamaged state at the time of initiation despite violent contact between the explosive delivery device and a target. Further, the bridge substrate 110 is constructed with structurally robust materials (e.g., ceramics) and acts as a support plate to support the explosive charge while minimizing deflection of the bridge substrate.

In contrast, the upwardly projecting leads elevated relative to the bridge substrate and the minimal surface area of the bridge substrate of many conventional initiator assemblies ensure the explosive charge experiences dynamic loading at localized positions around the explosive charge. Transmission of dynamic forces between the bridge substrate and the leads to the explosive charge (e.g., with the barrel therebetween) in these conventional initiator assemblies fractures the explosive charge and frustrates initiation of the explosive charge or causes the initiator assembly to fail entirely. The initiator assembly 100, as shown in FIG. 3, addresses this non-planar non-uniform contact between an explosive charge and a bridge substrate with the use of planar first and second bridge contacts 112, 114 substantially flush with the remainder of the uniform first planar surface 116 to form the continuous planar mounting surface 119 for surface-to-surface contact across the explosive charge 104. The bridge substrate 110 thereby supports the explosive charge 104 across substantially all of the charge mounting surface 125 thereby substantially preventing fracture of the explosive charge 104.

In addition to the uniform planar characteristics of the bridge substrate 110 the bridge substrate is constructed with structurally robust materials including one or more of ceramics, hard insulators, and the like. The materials of the bridge substrate 110 further support the explosive charge 104 and cooperate with the continuous planar mounting surface 119 to substantially ensure the explosive charge 104 is supported throughout dynamic changes to the initiator assembly 100 during impact and penetration of the explosive delivery device with a target. Stated another way, the bridge substrate 110 acts as a support plate to maintain a rigid support structure for the explosive charge and prevent fracture. Further, the example shows the circuit board 124 and the header 130 further cooperating with the bridge substrate 110 to provide additional support to the substrate as well as the explosive charge 104. Engagement between the components of the initiator assembly 100 including the header 130, the circuit board 124, the bridge substrate 110 and the explosive charge 104 ensures the explosive charge is stacked when held in the initiator assembly 100 and supported throughout dynamic changes to the assembly thereby substantially minimizing the risk of fracture of the explosive charge 104 even during impact and penetration of an explosive delivery device through a target. Further, the support provided by one or more of the bridge substrate 110 in combination with the circuit board 124 and the header 130 provides a rigid support to the bridge substrate 110 and the overlying ionizing bridge 120. Activation of the ionizing bridge 120 through the introduction of current across the first and second bridge contacts 112, 114 ensures the ionizing bridge 120 develops a pressure within the initiator cavity 103 that is fully directed toward the explosive 104 and the flyer plate 108. Reliable initiation of the explosive charge 104 is thereby attained. The isolation sleeve 138 further ensures the explosive charge 104 remains in an intact unfractured state during delivery of the explosive delivery device including the initiator assembly 100.

Figure 4:
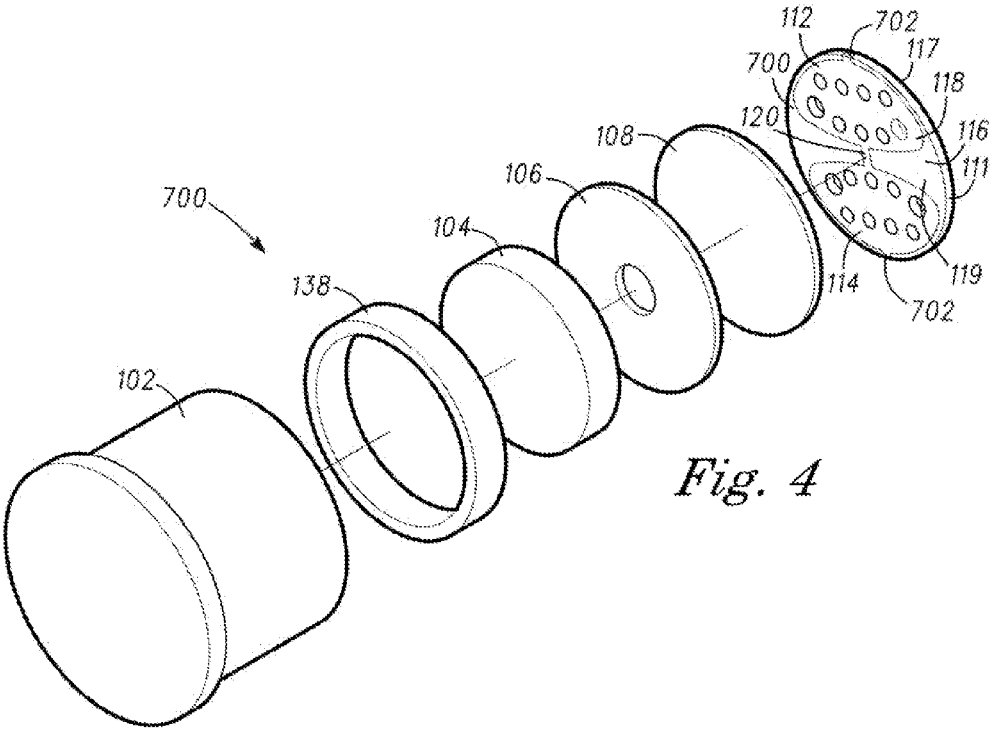
FIG. 4 is a cross sectional view of another example of an initiator assembly without a circuit board or header in accordance with some embodiments.

FIG. 4 shows another example of an initiator assembly 700. As with the previously described initiator assembly 100 the initiator assembly 700 includes an initiator housing 102, an isolation sleeve 138 and an explosive charge 104. The isolation sleeve 138 extends around the explosive charge 104. As shown in FIG. 4, the initiator assembly 700 further includes a barrel 106 and a flyer plate 108 adjacent to one another and positioned within a cavity within the initiator housing 102.

The initiator assembly 700 further includes a bridge substrate 700. The bridge substrate 700 is similar in some regards to the bridge substrate 110 previously described herein. For example, the bridge substrate 700 includes first and second bridge contacts 112, 114 and an ionizing bridge 120. The first and second bridging contacts 112, 114 include corresponding contact surfaces 118 that form a continuous planar mounting surface 119 with the uniform first planar surface 116. As described herein, the continuous planar mounting surface 119 is coupled along a corresponding portion of the explosive charge 104 to ensure a continuous surface-to-surface contact therebetween.

The bridge substrate 700 shown in FIG. 4 further includes one or more wrap around conductors 702. In one example the bridge substrate 700 includes a single wrap around conductor 702 coupled with one of the bridge contacts 112, 114. Optionally, the wrap around conductor 702 is electrically engaged with the initiator housing 102 and the initiator housing 102 serves a similar role to one of the initiator leads 128 shown in FIGS. 1 and 2. By using the initiator housing 102 as one of the initiator leads manufacturing and assembly of the initiator assembly 700 is facilitated by removing a component (i.e., one of the initiator leads) from the manufacturing and assembly process. In another example, the initiator assembly 700 includes a plurality of wrap around conductors 702. Each of the wrap around conductors is coupled with one of the bridge contacts 112, 114. In such an example, one of the wrap around conductors 702 is coupled with the initiator housing 102 as previously described and the remaining wrap around conductor 702 wraps around the perimeter of the bridge substrate 700 and engages with a corresponding backside conductor on the second surface 117 of the bridge substrate. Use of the wrap around conductor 702 in this manner eliminates the need for plated through holes such as the plated through holes 122 shown in FIG. 2. An initiator lead 128 couples with the backside conductor and thereby electrically connects with one of the bridge contacts 112, 114 through the wrap around conductor 702.

In the example shown in FIG. 4, the initiator assembly 700 includes a bridge substrate 700 but does not include a circuit board or header as described in previous examples. The bridge substrate 700 provides a robust support (e.g., a support plate) engaged with the initiator housing 102, for instance, by adhesive coupling of the bridge substrate 700 within the initiator housing 102 and supports the explosive charge 104 axially without needing the circuit board or header. In one example, the bridge substrate 100, for instance, the substrate base 111 is thicker and constructed with more robust materials to ensure the bridge substrate 700 properly supports the explosive charge 104 during dynamic loading of the initiator assembly 700 (e.g., during striking and penetration of the target). By removing the circuit board and header assembly manufacturing steps including the assembly of multiple initiator leads through plated through holes in one or more of circuit boards and headers is avoided as the initiator leads are directly coupled with the bridge substrate 700.

As described herein, the bridge substrate 700 generally has a circular configuration matched to the cross-sectional area of the initiator housing 102. The bridge substrate 700 further includes an area fully underlying the explosive charge 104 to ensure continuous surface to surface coupling between the explosive charge 104 and the bridge substrate 700. In other examples, the bridge substrate 700 (or 110) includes other shapes sized and shaped to fit within the initiator housing 102. For instance, the bridge substrate includes, but is not limited to, a star shaped, a triangular shape, a square shape or other configuration. Bridge substrates 700 with non-circular shapes are engaged with correspondingly shaped explosive charges 104. The bridge substrates thereby provide continuous surface-to-surface contact with similarly shaped explosive charges 104. In other examples, bridge substrates 700 with non-circular shapes overlie a portion of an explosive charge 104. For instance, where the bridge substrate 700 has a star shape one or more points of the star shaped support the perimeter portions of the explosive charge 104 thereby minimizing cracking of the explosive charge 104 during dynamic loading of the initiator assembly 700. That is to say, the bridge substrates 700 continue to provide a continuous planar mounting surface 119 sized and shaped for coupling along corresponding surfaces of the explosive charge 104. In still another example, the bridge contacts 112, 114 include other shapes beyond the ovular or kidney shapes provided in FIG. 2 and FIG. 4. For instance, the contact shapes 112, 114 are semi-circular in shape and thereby extend over a majority of the uniform first planar surface 116 of the bridge substrate 700. The bridge contacts 112, 114 with such a shape continue to provide structural support to the explosive charge 104 in combination with the uniform first planar surface 116. In yet another example, the bridge contacts 112, 114 have shapes including but not limited to squares, circles, lines, spiral configurations and the like.

Figure 5:
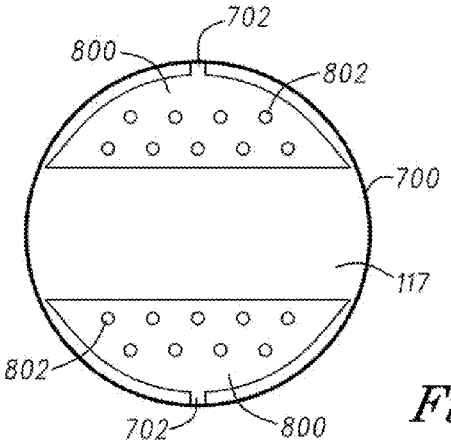
FIG. 5 is a bottom view of the bridge substrate shown in FIG. 4 in accordance with some embodiments.

FIG. 5 shows the bridge substrates 700 from the bottom relative to the view in FIG. 4. The second surface 117 is exposed with backside conductors 800 positioned along the second surface 117. In one example, the backside conductors 800 include plated through holes 802 extending through the bridge substrate 700 to the corresponding bridge contacts 112, 114 on the uniform first planar surface 116 (see FIG. 4). The plated through holes 802 electrically connect the first and second bridge contacts 112 with the backside conductors 800 to facilitate coupling of the contacts 112, 114 with the initiator leads 128 previously described and shown for instance in FIG. 3. In another example, the bridge substrate 700 includes one or more wrap around conductors 702 as previously shown in FIG. 4. In the example shown in FIG. 5 one or more of the wrap around conductors 702 extends around the perimeter of the bridge substrate 700 and is thereby electrically coupled between one backside conductor 800 and one of the bridge contacts 112, 114. Where the initiator assembly 700 includes initiator leads 128 one or more of the initiator leads 128 are coupled with the corresponding backside conductor 800 to thereby electrically couple the bridge contact 112 or 114 with the initiator leads 128. Optionally, one of the wrap around conductors 702 is coupled with the initiator housing 102. As described above, where the initiator housing 102 is constructed with an electrically conductive material, such as steel, the initiator housing 102 acts as a conductor and thereby eliminates the need for one of the initiator leads 128 shown in FIG. 1. Use of the wrap around conductors 702 eliminates one or more of the initiator leads 128 and thereby facilitates easier manufacturing and assembly of the initiator assembly 700.

In yet another example, the second surface 117 of the bridge substrate 700 includes one or more pins extending from the second surface 117. Stated another way, instead of providing backside conductors 800 the bridge substrate 700 provides one or more pins extending away from the second surface 117 for coupling with corresponding electronic components, such as a capacitor used for initiating the initiator assembly 700. Alternatively, the backside conductors 800 are used for coupling of the first and second bridge contacts 112, 114 with a circuit board, such as circuit board 124 through solder pads 126 shown in FIG. 2. In other examples, the backside conductors 800 facilitate electrical coupling with electronic components outside the initiator assembly 700 by coupling with flex cables, rigid connections, other circuits and the like. Optionally, the backside conductors are adapted for coupling with bulls eye connector pins, bulls eye connector screws, bulls eye spanner nuts and one or more spring contacts or other similar features.

Alternatively, conductive epoxy is applied along the backside conductors 800 for coupling with the circuit board or other leads, such as the initiator leads 128 described herein.

The initiator assemblies 100, 700 described herein are constructed with a plurality of components as described above. In one example, the bridge substrate is formed with a plurality of similar substrates along a frame (e.g., a sheet) where the bridge substrates 100, 700 are connected with the frame by tabs. The individual bridge substrates 100, 700 are thereafter separated from the sheets for use in separate initiator assemblies 100, 700. As shown in FIG. 2 and FIG. 4, the initiator assemblies 700 are formed by sequential loading of the various components within the initiator cavity of the initiator housing 102. After assembly of the components within the initiator housing 102 the initiator housing is closed, for instance, with an end cap and thereafter compressed to tightly engage each of the components and minimize movement of the components relative to each other when exposed to a dynamic environment, for instance, striking of a target and penetration through into the target. Alternatively, as previously described above, assembly of the initiator assemblies 100, 700 includes adhering one or more of the components, for instance, the bridge substrates, circuit boards and headers together prior to assembly within the initiator housing 102. Optionally, one or more of these components as well as the isolation sleeve 138, the explosive charge 104 and the barrel 106 is adhered within the initiator housing 102, for instance, by adhesives applied along the housing inner wall and the corresponding components of the initiator assembly.

CONCLUSION

The initiator assemblies described herein provide reliable axial and lateral support for the explosive charge and thereby prevent fracture of the explosive charge during dynamic loading through impact and penetration of an explosive delivery device with a target. A robust bridge substrate described herein provides structural support through surface-to-surface contact coupling between the bridge substrate and the explosive charge. Mechanical loads are spread over a large area of the bridge substrate mated to a corresponding area of the explosive charge. Because the bridge substrate presents a continuous planar mounting surface comprising the surface of the bridge substrate as well as the bridge contacts the explosive charge is reliably supported across its surface area to substantially prevent point loads at any location on the explosive charge. Rapid deceleration or acceleration of the initiator assembly with corresponding dynamic loading between the explosive charge and the bridge substrate is transmitted across the surface-to-surface contact between the two components and thereby substantially avoids any localized stresses at any point on the explosive charge.

Similarly, the isolation sleeve coupled around the explosive charge substantially prevents lateral stresses from fracturing the explosive charge where the explosive delivery device impacts and penetrates a target at a non-perpendicular angle. The explosive charge is thereby supported in axially and lateral directions throughout dynamic loading (e.g., for instance impact, penetration and the like) and is maintained in unitary unfractured state. Reliable and consistent initiation of the initiator assembly is thereby maximized while partial or entire failures of the initiator assembly to initiate are substantially minimized.

In the foregoing description, the subject matter has been described with reference to specific exemplary examples. However, it will be appreciated that various modifications and changes may be made without departing from the scope of the present subject matter as set forth herein. The description and figures are to be regarded in an illustrative manner, rather than a restrictive one and all such modifications are intended to be included within the scope of the present subject matter. Accordingly, the scope of the subject matter should be determined by the generic examples described herein and their legal equivalents rather than by merely the specific examples described above. For example, the steps recited in any method or process example may be executed in any order and are not limited to the explicit order presented in the specific examples. Additionally, the components and/or elements recited in any apparatus example may be assembled or otherwise operationally configured in a variety of permutations to produce substantially the same result as the present subject matter and are accordingly not limited to the specific configuration recited in the specific examples.

Benefits, other advantages and solutions to problems have been described above with regard to particular examples; however, any benefit, advantage, solution to problems or any element that may cause any particular benefit, advantage or solution to occur or to become more pronounced are not to be construed as critical, required or essential features or components.

As used herein, the terms "comprises", "comprising", or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present subject matter, in addition to those not specifically recited, may be varied or otherwise particularly adapted to specific environments, manufacturing specifications, design parameters or other operating requirements without departing from the general principles of the same.

The present subject matter has been described above with reference to examples. However, changes and modifications may be made to the examples without departing from the scope of the present subject matter. These and other changes or modifications are intended to be included within the scope of the present subject matter, as expressed in the following claims.

It is to be understood that the above description is intended to be illustrative, and not restrictive. Many other examples will be apparent to those of skill in the art upon reading and understanding the above description. It should be noted that examples discussed in different portions of the description or referred to in different drawings can be combined to form additional examples of the present application. The scope of the subject matter should, therefore, be determined with reference to the appended claims, along with the full scope of equivalents to which such claims are entitled.

What is claimed is:

1. An initiator assembly comprising:

an initiator housing including an initiator cavity having a cavity cross sectional area;

an explosive charge within the initiator cavity having a charge cross sectional area corresponding to the cavity cross sectional area;

a bridge substrate within the initiator cavity, the bridge substrate including:

a substrate base including a uniform first planar surface, and a continuous planar mounting surface extending along the explosive charge, the continuous planar mounting surface includes first and second bridge contacts and the first planar surface, the first and second bridge contacts are substantially flush with the first planar surface, and the continuous planar mounting surface has a mounting surface cross sectional area corresponding to each of the charge cross sectional area and the cavity cross sectional area;

a flyer plate within the initiator cavity and engaged along the continuous planar mounting surface;

a barrel engaged along the flyer plate, the barrel faces the explosive charge and extends continuously outward from a barrel lumen to an initiator cavity wall of the initiator cavity; and wherein each of the continuous planar mounting surface, the explosive charge, the flyer plate and the barrel are in continuous surface-to-surface contact across the initiator cavity from the barrel lumen to the initiator cavity wall.

2. The initiator assembly of claim 1, wherein the continuous planar mounting surface and the explosive charge extend continuously across the initiator cavity and the explosive charge, the continuous planar mounting surface and any intervening components including the flyer plate and the barrel are continuously statically engaged in surface-to-surface contact across the initiator cavity.

3. The initiator assembly of claim 1, wherein the first and second bridge contacts are elevated around 0.0015 inches or less relative to the first planar surface.

4. The initiator assembly of claim 1, wherein one or more of the first and second bridge contacts include plated through holes, and the plated through holes are recessed relative to at least the first planar surface.

5. The initiator assembly of claim 1 comprising an ionizing bridge electrically coupled between the first and second bridge contacts, wherein the bridge substrate includes a plate, and wherein the plate supports the bridge substrate and directs a pressure within the initiator cavity developed by ionization of the ionizing bridge toward the explosive charge.

6. The initiator assembly of claim 1 comprising a flyer plate positioned within the initiator cavity and adjacent to the explosive charge, wherein the bridge substrate, the explosive charge and the flyer plate are axially compressed within an initiator housing.

7. The initiator assembly of claim 1, wherein the bridge substrate continuously spreads mechanical loads across the explosive charge through surface-to-surface contact with the continuous planar mounting surface.

8. An initiator assembly comprising:

an initiator housing including an initiator cavity having a cavity cross sectional area;

an explosive charge within the initiator cavity having a charge cross sectional area corresponding to the cavity cross sectional area;

a bridge substrate within the initiator cavity, the bridge substrate includes:

a substrate base including a uniform first planar surface and an opposed second surface, and a first bridge contact extending from near an edge of the first planar surface to an ionizing bridge, a second bridge contact extending from near the edge of the first planar surface to the ionizing bridge, a continuous planar mounting surface extending along the explosive charge, the continuous planar mounting surface includes the first and second bridge contacts and the first planar surface, and the continuous planar mounting surface has a mounting surface cross sectional area corresponding to each of the charge cross sectional area and the cavity cross sectional area;

an isolation sleeve extending around the explosive charge and interposed between the initiator housing and the explosive charge, the isolation sleeve extends to the bridge substrate;

a flyer plate within the initiator cavity and engaged along the continuous planar mounting surface;

a barrel engaged along the flyer plate, the barrel extends continuously from a barrel lumen to a perimeter edge of the explosive charge, and the barrel faces the explosive charge; and wherein each of the continuous planar mounting surface, the explosive charge, the flyer plate and the barrel are in continuous surface-to-surface contact across the initiator cavity from the barrel lumen to at least the perimeter edge of the explosive charge.

9. The initiator assembly of claim 8, wherein the first and second bridge contacts are substantially flush with the first planar surface.

10. The initiator assembly of claim 9, wherein the first and second bridge contacts are elevated around 0.0015 inches or less relative to the first planar surface.

11. The initiator assembly of claim 8 comprising:

a circuit board adjacent to the opposed second surface of the bridge substrate;

a header adjacent to the circuit board; and wherein the opposed second surface is in continuous surface-to-surface contact with the circuit board, and wherein the circuit board is in continuous surface-to-surface contact with the header.

12. The method of claim 8 comprising axially compressing at least the explosive charge and the bridge substrate with a flyer plate and a barrel therebetween.

13. The method of claim 8 comprising spreading mechanical loads on the explosive charge across the continuous planar mounting surface according to the corresponding charge cross sectional area and mounting surface cross sectional area.

14. A method of making an initiator assembly comprising:

positioning an explosive charge within an initiator cavity having a cavity cross sectional area, the explosive charge having a charge cross sectional area corresponding to the cavity cross sectional area;

positioning a bridge substrate within the initiator cavity;

positioning a continuous planar mounting surface of the bridge substrate along the explosive charge, positioning including:

positioning a uniform first planar surface across the explosive charge, and positioning first and second bridge contacts across the explosive charge, the first and second bridge contacts substantially flush with the first planar surface, the continuous planar mounting surface includes each of the first planar surface and the first and second bridge contacts and has a mounting surface cross sectional area corresponding to each of the charge cross sectional area and the cavity cross sectional area;

positioning a barrel along the explosive charge, the barrel extending continuously from a barrel lumen to a perimeter edge of the explosive charge, the barrel having a barrel cross sectional area corresponding to the charge cross sectional area and the cavity cross sectional area; and positioning a flyer along the barrel and the continuous planar mounting surface, the flyer having a flyer cross sectional area corresponding to the barrel cross sectional area, the cavity cross sectional area and the mounting surface cross sectional area of the continuous planar mounting surface.

15. The method of claim 14 comprising interposing an isolation sleeve between the explosive charge and an initiator housing including the initiator cavity, the isolation sleeve extending to the continuous planar mounting surface.

16. The method of claim 14, wherein coupling the continuous planar mounting surface along the explosive charge includes coupling each of the continuous planar mounting surface, the flyer, the barrel and the explosive charge in a chain of surface-to-surface engagements, each of the surface-to-surface engagements extends across the initiator cavity.

* * * * *